US006852273B2

(12) United States Patent
Ivanov et al.

(10) Patent No.: US 6,852,273 B2
(45) Date of Patent: Feb. 8, 2005

(54) HIGH-STRENGTH METAL ALUMINIDE-CONTAINING MATRIX COMPOSITES AND METHODS OF MANUFACTURE THE SAME

(75) Inventors: Eugene Ivanov, Grove City, OH (US); Vladimir S. Moxson, Hudson, OH (US)

(73) Assignee: ADMA Products, Inc., Hudson, OH (US)

( * ) Notice: Subject to any disclaimer, the term of this patent is extended or adjusted under 35 U.S.C. 154(b) by 150 days.

(21) Appl. No.: 10/353,417

(22) Filed: Jan. 29, 2003

(65) Prior Publication Data

US 2004/0146736 A1 Jul. 29, 2004

(51) Int. Cl.[7] ..... C23C 10/28; C23C 30/00; B32B 5/18; B22F 3/12; B22F 3/16

(52) U.S. Cl. ..... 419/5; 419/27; 419/48; 419/53; 419/550; 419/557; 419/609; 419/651; 419/554; 148/240; 148/437; 148/535; 148/688

(58) Field of Search ..... 428/550, 554, 428/557, 609, 651; 419/5, 27, 48, 53; 148/240, 437, 535, 688

(56) References Cited

U.S. PATENT DOCUMENTS 3,164,884 A * 1/1965 Noble et al. ..... 29/17.5
3,941,182 A * 3/1976 Bjorksten et al. ..... 164/461
4,917,858 A * 4/1990 Eylon et al. ..... 419/28
4,992,237 A * 2/1991 May ..... 419/37
5,121,535 A * 6/1992 Wittenauer et al. ..... 29/423

* cited by examiner

*Primary Examiner*—John J. Zimmerman
*Assistant Examiner*—Jason L Savage

(57) ABSTRACT

(a) The metal matrix composite is suitable for the manufacture of flat or shaped titanium aluminide, zirconium aluminide, or niobium aluminide articles and layered metal composites having improved mechanical properties such as lightweight plates and sheets for aircraft and automotive applications, thin cross-section vanes and airfoils, heat-sinking lightweight electronic substrates, bulletproof structures for vests, partition walls and doors, as well as sporting goods such as helmets, golf clubs, sole plates, crown plates, etc. The composite material consists of a metal (e.g., Ti, Zr, or Nb-based alloy) matrix at least partially intercalated with a three-dimensional skeletal metal aluminide structure, whereby ductility of the matrix metal is higher than that of the metal aluminide skeleton. The method for manufacturing includes the following steps: (a) providing an aluminum skeleton structure having open porosity of 50–95 vol. %, (b) filling said skeleton structure with the powder of a reactive matrix metal, (c) compacting the aluminum skeleton/matrix powder composite preform by cold rolling, cold die pressing, cold isostatic pressing, and/or hot rolling, (d) consolidating the initial or compacted composite preform by sintering, hot pressing, hot rolling, hot isostatic pressing, and/or hot extrusion to provide, at least partially, a reaction between aluminum skeleton and matrix metal powder, and (e) diffusion annealing followed by any type of heat treatment needed to provide predetermined mechanical and surface properties of the resulting metal matrix composite. The combination of ductile matrix and metal aluminide skeletal structure results in significant improvement of mechanical properties of the composite material, especially hot strength. This high-strength aluminide-based material can also be used as a core component in multilayer metal matrix composites.

16 Claims, 1 Drawing Sheet

HIGH-STRENGTH METAL ALUMINIDE-CONTAINING MATRIX COMPOSITES AND METHODS OF MANUFACTURE THE SAME

FIELD OF THE INVENTION

The present invention relates to metal matrix composite materials containing aluminide alloys as structural components and to methods for manufacturing dense metal sheets and shaped composite articles from various metal powders, predominantly powders of reactive metals and alloys. More specifically, the invention relates to a method which would prevent oxidation, cracking, and other degradation during hot working of reactive metal articles, and which employs a combination of room temperature deformation (die pressing, cold rolling, cold isostatic pressing) and/or loose sintering, hot axial pressing, hot isostatic pressing, and/or hot rolling to form a dense solid microstructure of reactive alloys especially titanium aluminides and composites comprising titanium aluminides, CP titanium, and/or titanium alloys.

The present invention is extremely useful in the production of thin-wall articles of low ductile alloys, which oxidize rapidly at elevated temperatures. In addition to the metals set forth in the background of the invention, this invention is particularly useful in forming dense sheets, strips, and shaped articles containing pure titanium, titanium alloys, and titanium aluminide, both single-phase and multi-component alloys. Many other pure metals and numerous reactive alloys such as nickel aluminides, zirconium aluminides, and iron aluminides will also be suitable for metal forming by method of the present invention.

BACKGROUND OF THE INVENTION

Application, research and industrial production of aluminide-based alloys and titanium metal matrix composites (TiMMC) have progressed over the last 15 to 20 years to the current status of a pre-production engineered material. During that time, numerous industrially manufactured articles have been fabricated and tested with encouraging results. TiMMCs have demonstrated to be useful in a wide variety of aerospace applications for airframes and propulsion systems. The remaining challenge is the manufacturing development of titanium aluminide alloys, TiMMC and TiMMC-reinforced components that simultaneously satisfy the market-driven requirements of affordability, performance and reliability.

Most of these materials are based on or contain reactive metals and alloys initially supplied in powder form because powder metallurgy is the most effective way to process metal aluminide-containing alloys and composites. Reactive alloys might be determined as alloys that exhibit an increase in chemical interaction with oxygen, nitrogen, carbon, etc. at elevated temperatures. Titanium aluminide, high strength titanium alloys, nickel aluminides, zirconium aluminides, iron aluminides, beryllium alloys, refractory metals, niobium, and other metals represent this group of such reactive alloys. Dense sheets or foils of reactive metals such as titanium aluminides or nickel aluminides are used for manufacturing important structural elements ideally designed for aircraft and space applications, where high service temperature and high strength-to-density components are required. However, the fabrication of such products as thin gauge gamma-titanium aluminide sheets and shaped articles is extremely difficult because of their inherent low ductility. In addition, oxidation of these alloys is drastically increased at elevated temperatures that significantly hinder hot forming of sheet. Also, the undesired diffusion of a gas into a metal surface produces a decrease in ductility.

The aerospace industry continues to strive for larger production yields while reducing production costs, providing processing stability, and increasing the uniformity of microstructure of single-phase or multi-component titanium aluminide alloys, as well as composite materials based on these alloys.

The need for elevated temperatures during reactive metal processing has produced a number of previous techniques, which eliminate oxidation atmospheres from the environment of the metal during high-temperature processing. For example, hot working in large vacuum chambers or in inert gas environments is a common technique. However, the costly manufacturing facilities, which are required in these processes, add additional expenses to the final product. In many applications, an oxide layer is removed from a metal section by machining or the like.

Many technologies, known for manufacturing sheets of reactive metals, incorporate special coatings, claddings, or capsules that protect the reactive metal workpieces from oxidation and degradation during the hot forming process. For instance, in U.S. Pat. No. 3,164,884 to Noble et al., a method for the multiple hot rolling of sheets is disclosed, in which cover plates and sidebars are assembled around inner reactive metal plates separated by a release agent. The sidebars are welded to the cover plates and to each other along their outer edges. The release (separating) agents are liquid mixtures of aluminum, chromium, or magnesium oxides. Additional built-in vent holes permit gases, which are formed in the package during the hot rolling process, to escape.

In U.S. Pat. No. 5,121,535 to Wittenauer et al., a method of forming a reactive metal workpiece was created, which is protected from high-temperature oxidation during hot working by placing the workpiece in a malleable metal enclosure with a film of release agents interposed between major mating surfaces of the reactive metal section and the metal jacket. In a preferred embodiment, a metal section of a reactive metal is placed in a non-reactive metal frame. The reactive metal section and frame are then interposed between non-reactive metals from the top and bottom plates, with a release agent that exhibits viscous, glass-like properties at high temperatures being disposed at the interfaces of the reactive metal sections. The assembly is then welded together near the perimeter so that the release agent is sealed between the sections.

The welded assembly may then be hot rolled under pressure to the desired gauge using conventional hot rolling machinery and procedures to form the sheet. Other hot working techniques may be employed where suitable. Thus, accelerated oxidation during the high-temperature hot working of the reactive metal section is prevented using this patent, by encapsulating the reactive metal section in a non-reactive metal jacket.

Thereafter, the formed assembly or laminate is cooled, and the rolled assembly is sheared to remove the welded edges. The non-reactive metal sections are simply peeled from the reactive metal core by virtue of the brittle, non-cohesive release agent.

W. J. Truckner and J. F. Edd (U.S. Pat. No. 5,405,571) proposed a combination of tape casting and consolidation by hot pressing to manufacture thin sections from powders of titanium alloys, titanium aluminides, nickel aluminides, and molybdenum disilicide. The main drawback of this method is the residual porosity that is present in the final alloy due to traces of the polymer binder used in tape casting.

The U.S. Pat. No. 5,863,398 provides the manufacture of reactive alloys by hot pressing followed with sintering under pressure of 3000–5000 psi at 1300–1500° C. The method is characterized by low productivity and density gradient along the resulting thin material. This density gradient is caused by an error in parallelism between the punch and matrix of the hot pressing die that exists in the procedure.

K. Shibue, with co-workers, reported on the manufacture of shaped TiAl alloy by cold extrusion of an elemental powder blend in an aluminum can followed by hot isostatic pressing (U.S. Pat. No. 5,372,663). This method can be used to produce only symmetrical articles, e.g., rod-like. It is not suitable for thin sheets or strips.

Some cellular metal materials have been extensively developed and investigated in recent years. The potential for applying metal foams in lightweight constructions is the stiffness and impact absorption (see review of J. C. Benedyk, *Light Metal Age,* 2002, 60(3,4), p. 24–29). These foams can be processed by cold or hot deformation, as this was made with aluminum foam in the U.S. Pat. No. 5,972,285, to obtain controlled structure and porosity. These foams were also used as a structural component of composite materials being infiltrated with molten metals or filled with ceramic powders.

For example, U.S. Pat. No. 6,080,219 discloses composite materials consisting of nickel or ceramic foam filled with metal or plastic powders to obtain filters having controlled porosity. Such composites cannot be considered as reliable structural materials because their strength is completely dependent upon the properties of the foam, which are always lower than mechanical properties of a solid metal.

A porous iron foam structure is infiltrated by molten magnesium to produce a composite material with solidified Mg matrix filling the voids of the foam, as disclosed by Lev Tuchnsky in the U.S. Pat. No. 6,254,998. This composite has poor corrosion resistance because of the very low Fe content, which reduces the corrosion resistance of magnesium drastically. But more importantly, the Fe—Mg composites have no reserves to improve their physical or mechanical properties due to very low solubility of both elements.

Aluminum foam reinforced with steel wires (U.S. Pat. No. 3,941,182) is a more promising composite than the foam-based materials mentioned above, but it is not suitable as a structural material for heat-resistant and high-loaded applications.

All previous technologies of fabricating thin dense sheets and shaped articles from reactive alloys have considerable drawbacks, which make them undesirable in terms of strength and ductility of resulting titanium aluminide articles, sufficient protection from oxidation, cost, and production capacity, especially if these articles were produced initially from reactive alloy powders, which require additional hot working cycles for compacting. The resulting porosity causes very rapid oxidation of the reactive alloy to a substantial depth, and capsules designed in known inventions do not fully protect the sintered section from rapid oxidation. A significant difference in structural and mechanical properties between sintered sheets, produced from reactive metal powder, and the frame (capsule), produced from non-reactive wrought metal, result in non-uniform deformation and stress concentration of the laminate package during the hot rolling process. Cracks occur in various areas of the sintered section during the first cycles of hot rolling and do not allow it to maintain a stable manufacturing process.

Cellular metals were used in composites only as stiff structural component perceiving mechanical loading and protecting soft matrix. In this fashion, the strength of the composite is governed by the strength of the metal foam, e.g., by the strength of aluminum foam that is usually insufficient. Even the strength of such composites based on iron or nickel foams is significantly lower than the strength of solid metals due to the high-volume porosity of the foam.

Therefore, it would be desirable to provide (a) a high-strength and fully-dense metal matrix composite based on prospective aluminide alloys, and (b) a cost-effective method of producing this composite using powder reactive alloys, which improves the mechanical performance of resulting materials, and eliminates destructive oxidation during high-temperature processing. The present invention achieves this goal by using an aluminum skeletal structure filled with a reactive metal powder prior to hot working, and by providing a method by which the pre-structured skeleton/powder composite can be formed into fully-dense sheets or shaped articles in a hot working process combining loose sintering, hot axial pressing, hot isostatic pressing, and/or longitudinal hot deformation followed by a specified heat treatment.

OBJECTS OF THE INVENTION

It is therefore an object of the invention to produce a fully-dense, essentially uniform structure of flat and shaped metal matrix composite consisting of a high-strength, 3-D, skeletally structured metal aluminide, and ductile metal matrix of predominantly reactive alloy, which provides sufficient values of such mechanical characteristics as elongation, toughness, flexure and impact strength.

Another object of the invention is to control the structure of the flat or shaped metal composite by the formation of a predetermined structure of the compacted skeleton/powder preform, and then, an equi-axial microstructure of hot pressed or HIPed metals that will allow mechanical properties in the final product to be controlled.

It is yet another object of the invention to establish a continuous cost-effective process to produce fully dense flat and shaped metal matrix composites from reactive alloys based on single-phase and multi-component titanium aluminide alloys.

The nature, utility, and further features of this invention will be more apparent from the following detailed description with respect to preferred embodiments of the invented technology.

SUMMARY OF THE INVENTION

The invention relates to the manufacture of dense metal sheets, strips, and shaped composites from reactive metals based on single-phase and multi-component titanium aluminide alloys initially in sintered powder form.

The aims of the invention are (a) an improvement of mechanical properties of metal matrix composites containing aluminides (especially titanium aluminide) as a structural component, and (b) a low cost production process of metal matrix composites containing metals and alloys, which are reactive at high temperature in the manufacturing cycle.

We focused on the manufacturing engineering aspects of TiMMC and TiMMC-reinforced component fabrication with the goal of stabilizing the production of these materials. To this end, we have developed an affordable process utilizing reactive powder metals and alloys and a cost-effective manufacturing approach that has made a possible transition to production.

An attempt was also made to produce in-situ reinforced Ti-based composites (MMC's) using a blended elemental powder metallurgy approach. A new developed process allows uniform distribution of ductile and hard skeleton phases in the composite, as well as to uniformly disperse the reinforcing particulates in the matrix.

A combination of unique properties of (i) high strength and stiffness at temperatures up to 1500° F., (ii) good mechanical properties at room temperature including good ductility, and (iii) improved resistance to matrix cracking is achieved in the resulting material by forming a hybrid titanium alloy matrix composite in which the matrix consists of interconnected skeletons of at least two alloys, i.e. a high temperature-resistant titanium aluminide (or zirconium aluminide) alloy and a ductile, lower modulus titanium-based, niobium-base, nickel-based, or zirconium-based alloy, that are bonded metallurgically to each other in various embodiments. A reinforcing material in the form of filaments, fibers or whiskers, e.g., silicon carbide, can be embedded within one or both types of the matrix component.

While the use of a number of technologies for hot consolidation has previously been contemplated in the titanium aluminide industry as mentioned above, problems related to the formation of stiff preform able to suit a composite structure even during low-temperature consolidation, process stability and production costs, defective microstructure, residual porosity, and insufficient mechanical properties of dense aluminide-based sheets and shaped composites, have not been solved.

This invention overcomes shortcomings in the prior art by:

(1) designing a matrix composite consisting of titanium (or zirconium) or Ti-based alloy matrix intercalated with a three-dimensional skeletal titanium aluminide structure, whereby ductility of the matrix metal is higher than that of the titanium aluminide skeleton,
(2) providing an aluminum or aluminum alloy skeleton structure (preferably aluminum foam) having open porosity of 50–95%,
(3) filling said skeleton structure with the powder of the matrix metal to obtain an aluminum skeleton/matrix powder composite preform,
(4) compacting and consolidating said aluminum skeleton/matrix powder composite preform by cold rolling, cold die pressing, cold isostatic pressing, hot rolling, hot pressing, hot isostatic pressing, and/or hot extrusion in any combination to provide, at least partially, a reaction between aluminum skeleton and matrix metal powder,
(5) additional sintering and/or final diffusion annealing to decrease residual porosity, control the microstructure, and improve mechanical properties especially the ductility of the resulting metal sheets.

Compaction of powders before hot deformation can also be carried out by any one method selected from loose sintering, low-pressure sintering, cold pressing, direct powder rolling, cold isostatic or die pressing, or other means of room temperature and warm temperature consolidation.

In essence, the core of the invention is the technology providing reaction between aluminum skeleton and matrix metal powder to form a strong 3-D titanium aluminide structure in the ductile matrix of Ti or Ti-based alloy. The invented method allows the control of the composite microstructure by (a) tailoring the structure of aluminum skeleton, (b) customizing cold and hot deformation of the skeleton/powder preform, accompanied with (c) alloying and/or reinforcing the matrix metal, and (d) heat treatment realizing diffusion healing of the residual porosity, grain bonding, and dispersion-strengthening. The combination of high-strength 3-D aluminide skeleton with ductile matrix and controlled microstructure result in the significant improvement of mechanical properties of the dense sheets or shaped composite materials.

The method allows the control of the microstructure of the composite titanium aluminide sheets by changing parameters of hot pressing, HIPing, and heat treatment. It is fair to note that everything said here about titanium and titanium aluminide is also related to zirconium, niobium and other reactive alloys and their aluminides that can be used as base components of the composite material.

The method is suitable for the manufacture of flat or shaped titanium aluminide articles and metal matrix composites having improved mechanical properties such as lightweight plates and sheets for aircraft and automotive applications, thin cross-section vanes and blades, heat-sinking lightweight electronic substrates, bulletproof structures for vests, partition walls and doors, as well as for sporting goods such as helmets, golf clubs, sole plates, crown plates, etc.

The above mentioned and subsequent objects, features, and advantages of our invented technology will be clarified by the following detailed description of preferred embodiments of the invention.

DETAILED DESCRIPTION AND PREFERRED EMBODIMENTS OF THE INVENTION

Figure 1:
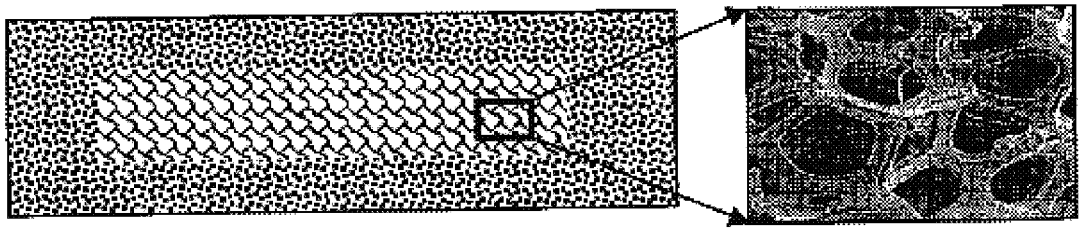
FIG. 1 is a cellular aluminum structure (aluminum foam) having open porosity of ~80 vol. %.

As discussed, the present invention relates generally to the manufacture of sintered titanium matrix composites strengthened by 3-D skeleton-like structure of titanium aluminide alloys using pre-alloyed powders (obtained by atomization or other method), elemental metal powder blends, and/or titanium hydrides, or a combinations thereof (i.e. combination of pre-alloyed, elemental and/or hydrides powders as raw materials). The reaction between these powders and aluminum foam provides the formation of the 3-D aluminide structure distributed uniformly in the ductile matrix, which results in significant gain in strength and elasticity of metal aluminide-based composites. The use of aluminum foam plays a very important role in this process resulting in the formation of a stiff composite preform in the first stages of the process, and in the formation of uniform density and microstructure in the final stage of the process. In methods known from the prior art, cellular aluminum exists as a main reinforcing component in the final structure of the composite. That is why the strength of composites containing cellular metal was as low as the strength of aluminum In our invention, aluminum foam plays a different role. By using aluminum foam, metal-aluminide-containing matrix composites are fabricated which have unique advantages. The Al foam fully reacts with Ti-containing or Zr-containing powder during the hot working of the preform and forms the reinforcing skeleton-like component of titanium aluminide in the final composite structure. This 3-D aluminide structure is responsible for the composite strength. Titanium aluminide holds high strength up to 800° C., and such mechanical behavior is now inherent in (peculiar to) the entire titanium/titanium aluminide composite made using our invention. The uniformity of density and microstructure provided by manufacturing a composite preform is very important in such processes, as well as the completion of diffusion bonding between powder particles and reinforcing 3-D aluminide that are being consolidated during the heating, hot deformation, and sintering.

No previously known methods, also mentioned in References, found the optimal ratio between the density and strength of previously compacted powder preform and the density and strength of the composite obtained after hot deformation and sintering. Most of the known methods use only a powder mixture of an atomized alloy or elemental powder blend as a starting material for hot processing. Therefore, the uniform density and a complete reaction between metal powders are not achieved, which results in irregular and uncontrolled porosity of the final structure of the sintered alloy. The weak preform prepared in the known methods is often cracked in the first stages of hot deformations that results in invisible but dangerous internal defects of the final microstructure. If titanium aluminide alloys or aluminide-containing composites are produced in the form of thick ingots, rods, or bars, low porosity or healed microcracks are not critical because they can be eliminated or neutralized at subsequent hot forming into the final product. But in the manufacture of sheets or thin shaped composites, any porosity, uneven density, or cracks are final defects that damage the quality and reliability of the final product. Such defects are not acceptable after hot processing of sheets or shaped composites made of any reactive powder alloys.

In accordance with our invention, a workpiece of cellular aluminum (FIG. 1) having a predetermined open porosity in the range of 50–95 vol. % is provided to be the carrying skeleton structure of the preform. The preferred porosity is in the range of 75–90 vol. %. The material of cellular aluminum can be selected from pure aluminum or any aluminum alloys, e.g., AA3003, or A356.0 (Al-7Si). These alloys have perfect resistance to hot cracking and provide sufficient strength of the composite preform during first stages of hot deformation. One must keep in mind that the use of aluminum alloys will result, after reacting with Ti or Zr powder, in the aluminide skeleton alloyed with Mn (if AA3003 is used) or with Si (if A356.0 was used). The porous aluminum or aluminum alloy skeletal structure can be manufactured in the form of metal foams, grits, fibrous structures, compacted powder or granular structures, sintered powder or granular structures, perforated plates, perforated foils, and/or structured inserts. Various combinations of material and foams of the cellular aluminum allow controlling the final structure of the composite and producing titanium/titanium aluminide, niobium/niobium aluminide, or zirconium/zirconium aluminide sheet and shaped composites in a wide range of mechanical properties.

Cold deformation of aluminum foam is another way to control the final composite microstructure or to tailor the preform structure before hot working. Another feature of the invention is that deformation of aluminum foam is also used to obtain shapes of the final composite article (e.g., the shape of a helmet or golf club) before hot working and sintering, because shaping already sintered composites is much more expensive or sometimes technically impossible. Cost-effective production of shaped titanium aluminide composites by easy deformation of cellular aluminum in the early stage of processing is an important advantage of our invented technology.

The prepared cellular aluminum is filled with a powder of titanium, zirconium, niobium, nickel, any titanium-based, zirconium-based alloy, nickel-based, or niobium-based alloy, e.g., powders of Ti-6Al-4V, Ti-6Al-6V-2Sn, R60702 (Zr-4Hf), Zr-30Ni, R60705 (Zr-4Hf-2Nb), Nitinol (Ni-50Ti), D-43 (Nb-10W-1Zr), or B-66 (Nb-5Mo-5V-1Zr) alloys, in any combination. The composition and combination of powders used are being selected according to the desired composition and properties of the composite matrix.

As a cost-reducing approach, titanium hydride or zirconium hydride powders, as well as an elemental powder blend having a composition corresponding to the predetermined composition of the matrix alloy can also be used to fill the aluminum foam.

Titanium hydride powder can be used to replace Ti powder in the blend or in the mixture of powder alloy with titanium powder. Titanium hydride improves the sinterability of powder blends, enhances the oxidation resistance of the powders during sintering, the cost of titanium hydride powder is less than the cost of pure titanium powder.

Powders used for filling aluminum foam can be pre-alloyed powders (produced by atomization, plasma rotated electrode process, mechanical alloying, or other means), blended elemental powders, hydrogenated powders, and/or a combination thereof.

Any powder of reactive alloys and metals can be used in the form of hydride in the raw powder mixture, and/or is hydrogenated prior to filling the aluminum foam Hydrogenation activates sintering of the preform by enhancing diffusion processes due to cleansing particles during hydrogen evaporation. At the higher temperature stage of hot pressing, hydrogen dissociates from the titanium hydride and aids in protecting the preform against oxidation.

Further, to improve microstructure and mechanical properties of the composite matrix, any titanium-based metal powder, used for filling the cellular aluminum skeleton structure, may additionally contain (a) low weight powders such as titanium aluminide, aluminum, aluminum-lithium alloys, and other metal powders, and (b) reinforcing particles of carbon, boron, titanium diboride, titanium carbide, silicon carbide, silica, alumina, silicon nitride, and other ceramics and ceramic-forming components, in any combination.

The raw reactive powder alloys and elemental powder blends may contain alloying elements such as V, Cr, Mo, Ni, Nb, Mn, B, Si, and others to manufacture composite materials having high-strength but ductile matrix of multicomponent Ti-based, Nb-based, Ni-based, and Zr-based alloys using our innovative technology.

For instance, a matrix of titanium/titanium aluminide composite sheet having the composition of Ti-6Al-4V can be made from the atomized true alloy or from the blend of titanium (or titanium hydride), aluminum, and vanadium powders. The use of elemental metal blends significantly cut production costs, and our invention benefits this approach. Our experience showed that the correct sequence of hot pressing, HIPing, and final heat treatment results in the uniform chemical composition along the matrix of obtained sheets manufactured from multicomponent alloys, whether or not the aluminim foam-structured preform was prepared from atomized alloy or from elemental metal blend.

Any reinforcing particulate or fiber-like components may be added in the raw powder mixtures to manufacture the initial preform and improve the mechanical characteristics of matrix, and thus, the entire composite sheets obtained after the appropriate hot processing. Ceramics such as titanium diboride, silicon carbide, silicon nitride, alumina, chromium oxide, amorphous silica, and/or metals such as tungsten, hafnium, niobium, molybdenum, their alloys, and/or other ceramics, metals and alloys, and/or a combination thereof can be used for this purpose. For example, a sheet 3 mm thick of metal matrix composite having a matrix of the above-mentioned Ti-6Al-4V alloy reinforced with 1.2 wt. % of $TiB_2$ particles was made by using the invented method from elemental powder blend included 1.2 wt. % of $TiB_2$ powder.

The cellular aluminum preform filled with the reactive powder alloy or the blend of elemental powders goes to hot deformation stage for consolidation, or it is initially compacted in the composite preform by room temperature rolling, hot rolling, cold pressing, cold isostatic pressing in any combination. The obtained rigid and relatively uniform preform provides a uniform application of the pressure and distribution of the temperature during hot processing that results in simultaneous reaction and diffusion interaction between aluminum skeleton and powder particles. It is also important that we make said preform in the form of relatively thin sections, with the thickness and shape similar to the final product.

Thus, only a combination of the rigid skeleton-structured preform with subsequent one- or multi-stage hot pressing, hot rolling, HIPing, and/or sintering allows to obtain fully-dense sheets and shaped composites from any reactive powder alloys, especially from titanium and titanium aluminide alloys in a cost-effective manner.

The aluminum skeleton/reactive powder composite preform can also be compacted by low-temperature loose sintering in a vacuum at 500–600° C., low-pressure sintering in an inert gas atmosphere, cold or warm pressing, cold or hot rolling at the tempearture less than 600° C., or by any combination thereof.

The consolidation of the compacted aluminum-titanium or aluminum-zirconium skeleton-structured preform is carried out by sintering, hot pressing, hot isostatic pressing (HIPing), hot rolling, or hot extrusion. For titanium-based powder alloys and for titanium aluminide-based alloys, the preferred tempearture range of sintering is 1100–1250° C. This means that these alloys are sintered at the temperature near the transus $\alpha \Rightarrow \alpha+\gamma$ temperatures 1150–1260° C. (2100–2300° F.). According to this invention, the sintering may be carried out with the temperature above the transus 2300–2500° F. All of these sintering regimes allow significantly sealing the sintering porosity and decreasing the open surface of the sintered powders. The resulting density of the sintered composite sheet depends on the powder form and size, and also on the temperature and process time.

The consolidated plate-like preform having relatively uniform density of the matrix allows reaching the density along the resulting composite sheets after subsequent hot deformation. The preliminary loose sintering near or above the $\alpha \Leftrightarrow \gamma$ transus point establishes active diffusion contacts between the powder particles. This results in the effective interaction between all components of the alloy during the subsequent hot processing. So, the final product obtained by this technology has not only uniform density, but also uniform chemical composition along the entire composite article.

Hot pressing, hot rolling, hot extrusion, and/or HIPing perform the hot deformation of the resulting porous preform after preliminary compaction or after loose sintering to increase the final density of the sintered product. Temperature and pressure values depend on the size, shape, morphology, and chemistry of the powder particles and on the shape and required density of the composite sheets.

Hot pressing is carried out in the temperature range of 950–1700° C., preferably at 1250–1450° C., and the pressure in the range of 50–350 kg/cm$^2$. Within these ranges, the exact working mode "time-pressure-temperature" was determined experimentally for successful pressing of the preform containing both atomized powder alloys and elemental powder blends of titanium, niobium, nickel, or zirconium matrix. Those proprietary technological regimes are considered to be "know-how".

Hot pressing can be performed in a solid graphite die or in a "flexible" die filled with graphite flakes. The graphite flakes behave as a liquid with the working temperature above 1000° C. and realize a sort of hydraulic effect during pressing. This effect allows adjusting the die surfaces to the surfaces of pressed porous preform in order to apply uniform pressure along the treated article during hot deformation. This approach is especially useful for the manufacture of large sheets of titanium/titanium aluminide or zirconium/zirconium aluminide composites.

Hot isostatic pressing can be used for hot forming the preform into the composite sheet itself or, to the hot pressing stage to eliminate a density gradient and obtain the uniform density along the resulting article. The density gradient sometimes appears in the pressed sheets, and is caused by nonparallel die surfaces, if dies are made from solid graphite. The combination of hot pressing with HIPing is also useful for the manufacture of large composite sheets. The initial or preliminary sintered preform subjected to HIPing is encapsulated in a metal container made from a metal that has better ductility than the HIPed workpiece.

The HIPing is carried out with the temperature ranging 1250–1350° C., with the pressure ranging 15000–40000 psi depending on the treated alloy and the shape and thickness of the resulting articles.

Hot rolling or extrusion of the preform is carried out with the temperature ranging 1100–1450° C. before HIPing. Hot rolling or extrusion can be used for forming the final thickness of the composite sheet, either from the initial thickness of the preform, or as an additional treatment after hot pressing to improve density and the shape of the hot-pressed semi-product. Hot rolling or extrusion can be performed in a vacuum, in a shielded atmosphere, or being encapsulated in a metal container to protect against oxidation.

Re-sintering or diffusion annealing of the deformed composite is the final step of controlling the structure. This procedure completes densification, forms additional strengthening intermetallics, secures the final grain size and size of dispersed phases, and releases residual stresses from the previous deformation. This treatment can also be used to increase the grain size and the size of dispersed phases, if necessary.

The resulting high-strength material containing 3-D aluminide-based structure can also be used as a core component in multilayer metal matrix composites. Such multilayer composites can be produced in the form of flat or shaped sandwiched structures, wherein both sides of the core composite component are covered with sintered or wrought metal layers.

The invented method allows manufacturing these multilayer composites in one technological cycle with the manufacture of the core matrix component containing 3-D aluminide-based structure, as described in Examples 8–10 for Ti-6Al-4V/titanium aluminide-based core/Ti-6AI-4V sandwich composites.

The foregoing examples of the invention are illustrative and explanatory. The examples are not intended to be exhaustive and serve only to show the possibilities of the invented technology.

EXAMPLE 1

The flat workpiece measuring 6"×12"×0.525" of aluminum foam having open porosity of ~80 vol. % was filled with the CP titanium powder having a particle size of −325 mesh. The obtained flat aluminum skeleton/titanium powder preform was hot pressed at 1250° C. and 150 kg/cm$^2$ for 1 hour. The pressure was maintained from 12 to 150 kg/cm$^2$ during the heating process that ranged from 500 to 1250° C.

Figure 2:
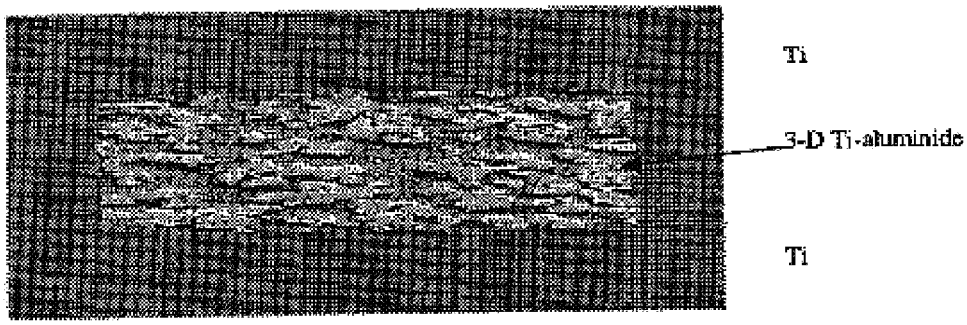
FIG. 2 is microstructure of titanium/titanium aluminide composite sheet consisting of ductile titanium matrix intercalated with 3-D TiAl structure.

The reaction between the titanium powder and aluminum foam started at ~650° C. and resulted in the formation of a skeleton-like titanium-aluminide structure. The resulting composite sheet 0.24" thick was fully dense, with a measured density of 4.1 g/cm$^3$. The microstructure of the composite consists of ductile titanium matrix and reinforcing a 3-D titanium aluminide structure (FIG. 2).

Samples 3"×0.5" were cut from the edge and central part of the sheet to measure Vickers microhardness and ultimate tensile strength at 20° C. and 500° C.

The particle size of the titanium powder, size and porosity of aluminum foam, and size of samples for mechanical testing were the same in all examples described below.

Mechanical properties of the composites are shown in Table 1. These tests showed that the titanium/titanium aluminide composite material lost only 23% of tensile strength at the testing temperature of 500° C. versus the strength at 20° C., while wrought CP titanium Grade 2 loses over 70% of the strength at the same temperature range.

EXAMPLE 2

The same flat workpiece of aluminum foam as in Example 1 was filled with the CP titanium powder. The obtained flat aluminum skeleton/titanium powder preform was cold rolled to the thickness of 0.4", sintered at 1100° C., and then hot pressed for 1 hour at 1250° C. and 150 kg/cm$^2$. The pressure was maintained from 12 to 150 kg/cm$^2$ during the heating process that ranged from 500 to 1250° C.

The reaction between titanium powder and aluminum foam started at ~650° C. during sintering and resulted in the formation of a skeleton-like titanium aluminide structure. The resulting hot-pressed composite sheet 0.2" thick was fully dense, with a measured density of 4.1 g/cm$^3$. The microstructure of the composite consists of ductile titanium matrix and reinforcing 3-D titanium aluminide structure. The resulting titanium/titanium aluminide composite material lost only 21% of tensile strength at the testing temperature of 500° C. versus the strength at 20° C.

EXAMPLE 3

The same flat workpiece of aluminum foam as in Example 1 was filled with pre-alloyed Ti-6Al-4V alloy powder. The obtained flat aluminum skeleton/titanium alloy powder preform was sintered at 1100° C., and then hot pressed for 1 hour at 1250° C. and 150 kg/cm$^2$. The pressure was maintained from 12 to 150 kg/cm$^2$ during the heating process that ranged from 500 to 1250° C.

The reaction between the titanium alloy powder and aluminum foam started at ~650° C. during the sintering and resulted in the formation of a skeleton-like titanium-aluminide structure. The resulting hot-pressed composite sheet 0.2" thick was fully dense, with a measured density of 4.05 g/cm$^3$. The microstructure of the composite consists of ductile Ti-6Al-4V alloy matrix and reinforcing 3-D titanium aluminide structure. The resulting Ti-6Al-4V/titanium aluminide composite material lost only 16% of tensile strength at the testing temperature of 500° C. versus the strength at 20° C., while wrought Ti-6Al-4V alloy Grade 5 loses about 50% of strength at the same temperature range.

EXAMPLE 4

The same flat workpiece of aluminum foam as in Example 1 was filled with blended elemental powders corresponding to the composition of titanium alloy Ti-6Al-4V. The obtained flat aluminum skeleton/titanium alloy powder preform was cold rolled to the thickness of 0.4", sintered at 1100° C., and then hot pressed for 1 hour at 1250° C. and 150 kg/cm$^2$. The pressure was maintained from 12 to 150 kg/cm$^2$ during the heating process that ranged from 500 to 1250° C.

The reaction between titanium powder and aluminum foam started at ~650° C. during sintering and resulted in the formation of a skeleton-like titanium-aluminide structure. The resulting hot-pressed composite sheet 0.2" thick was fully dense, with a measured density of 4.05 g/cm$^3$. The microstructure of the composite consists of ductile Ti-6Al-4V alloy matrix and reinforcing 3-D titanium aluminide structure. The resulting Ti-6Al-4V/titanium aluminide composite material lost only 15% of tensile strength at the testing temperature of 500° C. versus the strength at 20° C., while wrought Ti-6Al-4V alloy Grade 5 loses about 50% of strength at the same temperature range.

EXAMPLE 5

The same flat workpiece of aluminum foam as in Example 1 was filled with blended elemental powders corresponding to the composition of titanium alloy Ti-6Al-4V mixed with 1.2 wt. % if titanium diboride $TiB_2$. The obtained flat aluminum skeleton/titanium alloy powder preform was cold rolled to the thickness of 0.4", sintered at 1100° C., and then hot pressed for 1 hour at 1250° C. and 150 kg/cm$^2$. The pressure was maintained from 12 to 150 kg/cm during the heating process that ranged from 500 to 1250° C.

The reaction between titanium powder and aluminum foam started at ~650° C. during sintering and resulted in the formation of a skeleton-like titanium-aluminide structure. The hot-pressed composite sheet 0.2" thick was annealed for 2 hours at 1050° C. The resulting composite sheet was fully dense, with a measured density of 4.05 g/cm$^3$. The microstructure of the composite consists of ductile Ti-6Al-4V alloy matrix reinforced with TiB2 and 3-D titanium aluminide structure.

The resulting Ti-6Al-4V/titanium aluminide composite material lost only 13% of tensile strength at the testing temperature of 500° C. versus the strength at 20° C., while wrought Ti-6Al-4V alloy Grade 5 loses about 50% of strength at the same temperature range.

EXAMPLE 6

The same flat workpiece of aluminum foam as in Example 1 was filled with the pre-alloyed powder of titanium alloy Ti-6Al-4V. The obtained flat aluminum skeleton/titanium alloy powder preform was encapsulated in a container of mild steel, sintered at 1100° C., and then, HIPed for 2 hours at 1250° C. and 20 ksi.

The reaction between titanium powder and aluminum foam started at ~650° C. during sintering and resulted in the formation of a skeleton-like titanium-aluminide structure. The HIPed composite sheet 0.125" thick was annealed for 2 hours at 1050° C. The resulting composite sheet was fully dense, with a measured density of 4.05 g/cm$^3$. The microstructure of the composite consists of ductile Ti-6Al-4V alloy matrix and reinforcing 3-D titanium aluminide structure.

The resulting Ti-6Al-4V/titanium aluminide composite material lost only 12% of tensile strength at the testing temperature of 500° C. versus the strength at 20° C., while wrought Ti-6Al-4V alloy Grade 5 loses about 50% of strength at the same temperature range.

TABLE 1

Physical and mechanical properties of titanium/titanium aluminide matrix composite sheets manufactured by invented method

| Example | Matrix alloy | Vickers hardness, HV | | Ultimate tensile strength of composite, MPa (ksi) | |
|---|---|---|---|---|---|
| | | Matrix | TiAl skeleton | at 20° C. | at 500° C. |
| 1 | Ti | 860 | 5200 | 540–553 (78.2–80.1) | 416–425 (60–62) |
| 2 | Ti | 860 | 5260 | 559–574 (81.0–83.2) | 442–453 (64–66) |
| 3 | Ti—6Al—4V | 3200 | 5600 | 813–822 (118–119) | 682–690 (98–100) |
| 4 | Ti—6Al—4V | 3200 | 5800 | 828–842 (120–122) | 704–716 (102–104) |
| 5 | Ti—6Al—4V—1.2$TiB_2$ | 3400 | 5400 | 891–904 (129–131) | 775–786 (112–114) |
| 6 | Ti—6Al—4V | 3200 | 5900 | 880–908 (127–131) | 774–798 (112–116) |
| C.P. Ti Grade 2 | | | | 560 (81.2) | 110 (15.9) |
| Ti—6Al—4V | | | | 900–1000 (130–144) | 500–520 (72–75) |

EXAMPLE 7

The same flat workpiece of aluminum foam as in Example 1 was filled with blended elemental powders corresponding to the composition of titanium alloy Ti-6Al-4V. The obtained flat aluminum skeleton/titanium alloy powder preform was cold die-pressed at 40,000 psi to 85% of theoretical density to produce the shaped composite airfoil, sintered at 1100° C., and then hot pressed for 1 hour at 1250° C. and 150 kg/cm$^2$. The pressure was maintained from 12 to 150 kg/cm$^2$ during the heating process that ranged from 500 to 1250° C.

The reaction between titanium powder and aluminum foam started at ~650° C. during sintering and resulted in the formation of a skeleton-like titanium-aluminide structure. The hot-pressed composite airfoil was annealed for 2 hours at 1050° C. The resulting composite airfoil was fully dense, with a measured density of 4.05 g/cm$^3$. The microstructure of the composite consists of ductile Ti-6Al-4V alloy matrix and 3-D titanium aluminide structure.

EXAMPLE 8

The powder of Ti-6Al-4V alloy having a particle size of −100 mesh was applied to the surface of a graphite die to form the first powder layer measuring 6"×12"×0.5". The surface of the die was preliminarily coated with a release agent by spraying a suspension of yttrium oxide.

The core preform comprising aluminum foam filled with the pre-alloyed Ti-6Al-4V powder as in Example 3, was applied to the first powder layer mentioned above, and the second powder layer of the same alloy and size was applied to the top of the core aluminum/titanium preform.

The obtained three-layer flat package consisting of (1) the bottom powder layer, (2) the aluminum skeleton/titanium alloy powder preform, and (3) the top powder layer was loose sintered at 1100° C., and then hot pressed for 1.5 hour at 1250° C. and 150 kg/cm$^2$. The pressure was maintained from 12 to 150 kg/cm$^2$ during the heating process that ranged from 500 to 1250° C.

The reaction between titanium powder and aluminum foam started at ~650° C. during sintering and resulted in the formation of a multilayer composite material consisting of a core matrix composite of Ti-6Al-4V/titanium-aluminide structure covered with the top and bottom sintered Ti-6Al-4V layers. The hot-pressed multilayer composite was annealed for 2 hours at 1050° C. The resulting composite material was fully dense, with a measured average density of 4.23 g/cm$^3$. The microstructure of the composite core consists of ductile Ti-6Al-4V alloy matrix and 3-D titanium aluminide structure supported with relatively ductile Ti-6Al-4V alloy layers on both sides of the core.

EXAMPLE 9

The first sheet of Ti-6Al-4V alloy having a thickness of 0.1" was applied to the surface of a graphite die. The surface of the die was preliminarily coated with a release agent by spraying a suspension of yttrium oxide.

The core preform comprising aluminum foam, filled with blended elemental powders corresponding to the composition of titanium alloy Ti-6Al-4V as in Example 4, was applied to the first sheet mentioned above, and the sheet of the same alloy and thickness was applied to the top of the core aluminum/titanium preform.

The obtained three-layer flat package consisting of (1) the bottom Ti-6Al-4V alloy sheet, (2) the core aluminum skeleton/titanium alloy powder preform, and (3) the top Ti-6Al-4V alloy sheet was hot pressed for 1 hour at 1250° C. and 150 kg/cm$^2$, and then, HIPed for 2 hours at 1250° C. and 20 ksi.

The reaction between titanium powder and aluminum foam started at ~650° C. during hot pressing and resulted in the formation of a multilayer composite material consisting of a core matrix composite of Ti-6Al-4V/titanium-aluminide structure covered with the top and bottom Ti-6Al-4V sheets metallurgically-bonded with the composite core. The HIPed multilayer composite was annealed for 2 hours at 1050° C. The resulting composite material was fully dense, with a measured average density of 4.34 g/cm$^3$. The microstructure of the composite core consists of ductile Ti-6Al-4V alloy matrix and 3-D titanium aluminide structure supported with relatively ductile Ti-6Al-4V alloy sheets on both sides of the core.

EXAMPLE 10

Two flat workpieces of aluminum foam (as in Example 1) were filled with blended elemental powders corresponding to the composition of titanium alloy Ti-6Al-4V. The third workpiece of the same size aluminum foam was filled with blended elemental powder corresponding to the composition of γ-TiAl alloy.

The core preform comprising aluminum foam, filled with the γ-TiAl powder was assembled with two outside preforms to obtain a three-layer flat package consisting of (1) the bottom layer of aluminum skeleton/Ti-6Al-4V powder, (2) the core aluminum skeleton/γ-TiAl powder preform, and (3) the top layer of aluminum skeleton/Ti-6Al-4V powder.

This three-layer package was hot pressed for 1 hour at 1250° C. and 150 kg/cm$^2$, and then HIPed for 2 hours at 1250° C. and 20 ksi.

The reaction between titanium powder and aluminum foam started at ~650° C. during hot pressing and resulted in the formation of a multilayer composite material consisting of a core matrix composite of γ-TiAl/γ-TiAl structure covered with the top and bottom sintered Ti-6Al-4V layers. The HIPed multilayer composite was annealed for 2 hours at 1050° C. The resulting sandwiched composite material was fully dense, with a measured average density of 4.07 g/cm$^3$.

The microstructure of the composite core consists of high-strength γ-TiAl layer supported with two high-strength composite layers consisting of relatively ductile Ti-6Al-4V alloy matrix and 3-D titanium aluminide structure.

We claim:

1. Method of manufacturing high-strength metal aluminide-containing matrix composite including the steps of (a) providing an aluminum or aluminum alloy skeleton structure having open porosity of 50–95 vol. %;

(b) filling said skeleton structure with the powder of a reactive matrix metal and/or reactive alloy to obtain an aluminum skeleton/matrix powder composite preform;

(c) compacting said aluminum skeleton/matrix powder composite preform by cold rolling, cold die pressing, cold isostatic pressing, and/or hot rolling in any combination;

(d) consolidating the initial or compacted aluminum skeleton/matrix powder composite preform by sintering, hot pressing, hot rolling, hot isostatic pressing, and/or hot extrusion in any combination to provide, at least partially, a reaction between aluminum skeleton and matrix metal powder;

(e) diffusion annealing and/or additional sintering followed by any type of heat treatment needed to provide predetermined mechanical and surface properties of the resulting metal matrix composite.

2. Method of manufacturing high-strength hybrid titanium/titanium aluminide composite according to claim 1, wherein the porous aluminum or aluminum alloy skeleton structure is manufactured in the form of metal foams, grits, fibrous structures, compacted powder or granular structures, sintered powder or granular structures, perforated plates, perforated foils, and/or structured inserts.

3. Method of manufacturing high-strength metal aluminide-containing matrix composite according to claim 1, wherein the aluminum or aluminum alloy skeleton structure is filled with an elemental powder blend having a composition corresponding to the predetermined composition of the matrix alloy.

4. Method of manufacturing high-strength metal aluminide-containing matrix composite according to claim 1 wherein any powder of the matrix metal and/or alloy contains a titanium hydride and/or zirconium hydride.

5. Method of manufacturing high-strength metal aluminide-containing matrix composite according to claim 1 wherein any matrix metal and/or alloy powder, used for filling the aluminum skeleton structure, additionally contains (a) low weight powders such as titanium aluminides, aluminum, aluminum-lithium alloys, and other metal powders, and/or (b) reinforcing particles of carbon, boron, titanium diboride, titanium carbide, silicon carbide, silica, alumina, silicon nitride, and other ceramics and ceramic-forming components, in any combination, and/or (c) alloying elements such as vanadium, chromium, molybdenum, nickel, niobium, hafnium, manganese, boron, silicon, and others to obtain a matrix of multi-component titanium-based, zirconium-based, nickel-based, or niobium-based alloy.

6. Method of manufacturing high-strength metal aluminide-containing matrix composite according to claim 1 wherein the reactive powder alloys are pre-alloyed powders (produced by atomization, plasma rotated electrode process, mechanical alloying, or other means), blended elemental powders, hydrogenated powders, and/or a combination thereof.

7. Method of manufacturing high-strength metal aluminide-containing matrix composite according to claim 1, wherein the aluminum or aluminum alloy skeleton structure is preliminarily deformed prior to filling it with the matrix powder to tailor the skeleton structure and/or to obtain the final shape of the resulting composite article.

8. Method of manufacturing high-strength metal aluminide-containing matrix composite according to claim 1, wherein the aluminum or aluminum alloy skeleton structure is deformed after filling it with the matrix powder to tailor the skeleton structure and/or to obtain the final shape of the resulting composite article.

9. Method of manufacturing high-strength metal aluminide-containing matrix composite according to claim 1, wherein the preform filled with the matrix powder is encapsulated in a metal container before hot working especially by hot isostatic pressing and/or extruding.

10. The high-strength metal aluminide-containing matrix composite formed by the method according to claim 1 which consists of a metal and/or alloy matrix at least partially intercalated with a three-dimensional skeletal metal aluminide structure, whereby ductility of the matrix metal and/or alloy is higher than that of the metal aluminide skeleton.

11. The high-strength metal aluminide-containing matrix composite according to claim 10, wherein the matrix metal and/or alloy is selected from a group consisting of titanium, zirconium niobium, nickel, titanium-based alloy, zirconium-based alloy, niobium-based alloys, nickel-based alloys, other reactive alloys, and/or a mixture thereof, and the metal aluminide is selected from a group consisting of titanium aluminide alloys, zirconium aluminide alloys, niobium aluminide alloys, nickel aluminide alloys, and/or aluminide alloys of other reactive metals, and/or a mixture thereof.

12. The high-strength metal aluminide-containing matrix composite according to claim 10, comprises (a) at least one core layer of the high-strength metal aluminide-containing matrix composite consisting of reactive metal and/or alloy matrix intercalated with the three-dimensional skeletal metal aluminide structure, and (b) at least one layer of sintered, wrought, or cast reactive metal and/or alloy metallurgically bonded to the core layer.

13. Method of manufacturing high-strength metal aluminide-containing matrix composite according to claim 12, includes:

(a) providing an aluminum or aluminum alloy skeleton structure having open porosity of 50–95 vol. %;

(b) filling said skeleton structure with a titanium powder, a titanium hydride powder, and/or a titanium alloy powder to obtain an aluminum skeleton/titanium powder composite preform;

(c) compacting said aluminum/titanium composite preform by cold rolling, cold die pressing, cold isostatic pressing, and/or hot rolling in any combination;

(d) depositing at least one layer of titanium and/or titanium alloy powder on at least one side of the compacted aluminum/titanium composite preform to form a multilayer composite package;

(e) cold die pressing and/or loose sintering of the multilayer composite package;

(f) consolidating the multilayer composite package by sintering, hot pressing, hot isostatic pressing, hot rolling, and/or hot extrusion in any combination to provide a reaction between aluminum skeleton and titanium matrix powder, as well as to provide metallurgical bonding between the core composite layer and titanium and/or titanium alloy powder layers;

(g) diffusion annealing and/or additional sintering followed by any type of heat treatment needed to provide predetermined mechanical and surface properties of the resulting multilayer metal matrix composite.

14. Method of manufacturing of high-strength metal aluminide-containing matrix composite according to claim 12, includes:

(a) forming the first layer of titanium and/or titanium alloy powder, (b) applying an aluminum or aluminum alloy skeleton structure having open porosity of 50–95 vol. % on the first powder layer, (c) filling said skeleton structure with a titanium powder, a titanium hydride powder, and/or a titanium alloy powder to obtain an aluminum skeleton/titanium powder composite preform, (d) depositing the second layer of titanium and/or titanium alloy powder on the aluminum/titanium composite preform to form a multilayer composite package, (e) compacting said multilayer composite package by cold rolling, cold die pressing, and/or cold isostatic pressing in any combination, (f) loose sintering of the multilayer composite package, (g) consolidating the multilayer composite package by sintering, hot pressing, hot isostatic pressing, hot rolling, and/or hot extrusion in any combinations to provide a reaction between aluminum skeleton and titanium matrix powder, as well as to provide metallurgical bonding between core composite layer and titanium and/or titanium alloy powder layers, and (h) diffusion annealing and/or additional sintering followed by any type of heat treatment needed to provide predetermined mechanical and surface properties of the resulting maltilayer metal matrix composite.

15. Method of manufacturing high-strength metal aluminide-containing matrix composite according to claim 12, includes:

(a) providing the first flat or shaped sheet of titanium and/or titanium alloy;

(b) applying a flat or shaped aluminum or aluminum alloy skeleton structure having open porosity of 50–95 vol. % on the first titanium sheet;

(c) filling said skeleton structure with a titanium powder, a titanium hydride powder, and/or a titanium alloy powder to obtain an aluminum skeleton/titanium powder composite preform;

(d) applying the second flat or shaped sheet of titanium and/or titanium alloy on the aluminum/titanium composite preform to form a multilayer composite package;

(e) compacting said multilayer composite package by cold rolling, cold die pressing, and/or cold isostatic pressing in any combination;

(f) consolidating the multilayer composite package by sintering, hot pressing, hot isostatic pressing, hot rolling, and/or hot extrusion in any combination to provide a reaction between aluminum skeleton and titanium matrix powder, as well as to provide metallurgical bonding between core composite layer and titanium and/or titanium alloy sheets;

(g) diffusion annealing and/or additional sintering followed by any type of heat treatment needed to provide predetermined mechanical and surface properties of the resulting multilayer metal matrix composite.

16. Method of manufacturing high-strength metal aluminide-containing matrix composite according to claim 12, includes:

(a) providing at least two aluminum or aluminum alloy skeleton structures having open porosity of 50–95 vol. %;

(b) filling said skeleton structures with matrix metal powders, that are different for each skeleton structure, to obtain at least two aluminum skeleton/matrix powder composite preforms;

(c) assembling the aluminum skeleton/matrix powder composite preforms in one multilayer composite package;

(d) consolidating the multilayer composite package by sintering, hot pressing, hot isostatic pressing, hot rolling, and/or hot extrusion in any combination to provide a reaction between aluminum skeleton and matrix metal powder, as well as to provide metallurgical bonding between all layers of the multilayer composite;

(e) diffusion annealing and/or additional sintering followed by any type of heat treatment needed to provide predetermined mechanical and surface properties of the resulting multilayer metal matrix composite.

* * * * *